US009359757B1

(12) United States Patent
King

(10) Patent No.: US 9,359,757 B1
(45) Date of Patent: Jun. 7, 2016

(54) CONCRETE WELDMENT

(71) Applicant: Ming-Ta King, Chicago, IL (US)

(72) Inventor: Ming-Ta King, Chicago, IL (US)

( * ) Notice: Subject to any disclaimer, the term of this patent is extended or adjusted under 35 U.S.C. 154(b) by 0 days.

(21) Appl. No.: 14/717,225

(22) Filed: May 20, 2015

(51) Int. Cl.
*E04B 1/41* (2006.01)
*E04B 1/04* (2006.01)
*E04C 2/04* (2006.01)

(52) U.S. Cl.
CPC . *E04B 1/41* (2013.01); *E04B 1/043* (2013.01); *E04C 2/044* (2013.01); *E04B 2103/02* (2013.01); *E04B 2103/06* (2013.01)

(58) Field of Classification Search
CPC ..... E04G 21/14; E04G 17/002; E04B 1/41; E04B 1/043; E04B 2103/02; E04C 2/044
USPC ..... 52/583.1, 125.4, 699, 703, 712, 582.1
See application file for complete search history.

(56) References Cited

U.S. PATENT DOCUMENTS 3,958,954 A * 5/1976 Ehlenbeck ..... E04B 1/215 428/584
4,724,649 A * 2/1988 Lowndes, III ..... E04B 1/215 52/583.1
5,402,616 A 4/1995 Klein
6,185,897 B1 * 2/2001 Johnson ..... E04B 1/41 52/582.1
6,668,506 B2 * 12/2003 Snauwaert ..... E01C 5/08 52/582.1
6,854,232 B2 2/2005 Snauwaert
7,461,492 B1 * 12/2008 Francies, III ..... E04B 1/483 52/125.4
7,934,343 B2 5/2011 Fletcher et al.
8,522,501 B2 * 9/2013 King ..... B82B 23/0056 52/125.4
2003/0140590 A1 7/2003 Lancelot, III et al.
2007/0056242 A1 * 3/2007 Sample ..... E04B 1/41 52/698
2012/0192506 A1 * 8/2012 King ..... B82B 23/0056 52/125.4

* cited by examiner

*Primary Examiner* — Beth Stephan
(74) *Attorney, Agent, or Firm* — Knechtel, Demeur & Samlan

(57) ABSTRACT

A concrete weldment has a central plate with shear force reinforcing members at both ends of the central plate. There is a pair of outstanding arms extending out from each of the ends of the shear reinforcing members. The shear reinforcing members are twisted approximately 45° so that the outstanding arms are rotated substantially 45°. This rotation preserves the vertical and horizontal shear capacity of the weldment as well as to keep the slab reinforcement means well protected with proper concrete coverage. Each of the outstanding arms has a 90 degree bend at the ends for providing increased pull out tensile capacity of the weldment.

8 Claims, 5 Drawing Sheets

CONCRETE WELDMENT

FIELD OF THE INVENTION

This invention relates to a metal weldable piece that is embedded into a thin concrete slab type structure and the method of manufacturing the slab so that the weldable piece is properly positioned in the slab. The weldable piece is used to join adjacent concrete structures or slabs by welding together the weldable piece embedded in each of the concrete structures.

More specifically, the invention is directed to:

(1) Connecting "THIN SLAB" (three inches or less) precast structure only. It is not practical to use this type of weldment for slab thickness exceeding 3 inches.

(2) Twisting of both arms for 45 degree for providing room for concrete coverage of the reinforcement and maintaining the vertical shear capacity of the connection.

(3) A central plate having a 30 degree angle out of vertical to provide an easier orientation for field welding.

(4) Automatic stamping and the minimizing of material waste to provide the manufacturing by most economical manufacture product.

BACKGROUND AND SUMMARY OF THE INVENTION

Precast thin concrete slab type structures are commonly used in constructing roof, floors, and concrete decks. They generally take the shape of concrete slabs which may have a t-shape in cross section. There is a horizontal portion of the slab which is the load bearing surface and there is generally reinforcing mesh or bars within the slab. There is at least one generally flat surface or edge that adjoins a flat surface or edge of a confronting adjacent slab. The top surface of the slab is usually kept rough to be ready to receive a cast in place composite concrete topping with topping reinforcements which is a minimum 2 inches thick.

When the concrete slabs are placed next to each other to form the deck, it is possible for the slabs to move with respect to each other. This is due to construction loading, wind forces or thermal expansion. In order to prevent or minimize the relative movement and to increase the strength of the final structure, metal inserts, often called "weldments" are placed within the concrete slabs with a portion of the weldment extending out from an edge of the slab. When the slabs are positioned for final assembly, the metal weldment of one slab is aligned with and opposite to a complementary metal weldment in an adjacent slab (see FIGS. 7 and 8). The complementary metal weldments are welded to each other to join the two weldments. This results in a unitary structure that is much stronger and less prone to movement than if no means of joining the slabs were used. While designing the connection and the weldment, the following aspects are considered:

(A) horizontal shear capacity (Vh) to provide the diaphragm force, (B) tensile capacity (T), (C) vertical shear force (Vv) to resist the uneven loading between adjacent slabs, (D) concrete coverage of slab reinforcement to be maintained before the topping is installed in the field, (E) ease of placement of the loose welding steel and ease of welding, and (F) overall material cost.

Various types of weldments have been used in the past. Once such type which has been used is illustrated in U.S. Publication No. 2003/0140590 to Lancelott, III et al. This is a U-shaped thin steel plate that had two arms of the "U" embedded within the concrete and the base of the "U" exposed along the edge of the concrete slab. Due to its pointing shape, the arms often are pulled out from the slab when under tensile load. This is unacceptable as it substantially weakens the overall structure.

Another weldment which has been used is illustrated in U.S. Pat. No. 5,402,616. This type of weldment solved some problems except its vertical arms are deep which sacrifices the concrete coverage above the slab reinforcement especially when the total slab thickness is thin. This type of weldment is very helpful for thick slabs that have sufficient space to provide concrete coverage above the slab reinforcement, but it provides unacceptable coverage for thinner slab structure.

Another weldment is illustrated in U.S. Pat. No. 6,854,232. The vertical arms of this type of weldment are rotated almost 90 degree to make room for the weldment, slab reinforcement and its concrete coverage. A major problem with this weldment is that at the extreme degree bend location, a hinge point is created which reduces the vertical shear capacity of the weldment and creates localized spall beneath or above the weldment. This reduces the strength of the weldment.

Thus, there is the need for a concrete weldment having improved securing properties over the weldments illustrated in the prior art that results in the weldment being more securely retained within the thin concrete slab with proper slab reinforcement's concrete coverage, even when the weldment is subjected to vertical and horizontal forces. Applicant's invention provides an increased weldable area, at the proper angle to the concrete surface for easier welding proposes, and allows for thermal expansion of the weldment without cracking and spalling the concrete.

Applicant's invention solves the problems stated above by providing a weldment that comprises a central plate which defines the weldable surface. The central plate is at approximately 30 degree angle with respect to the vertical edge of the concrete slab which solves the problems of providing an easily accessible weldable surface. There are shear force reinforcing members at both ends of the central plate. The reinforcing members are designed to minimize the twisting length in order to avoid interfering with the slab reinforcement mesh or reinforcing bars that are placed in the slab. The maximum amount of twisting or rotation is limited to 45 degree in order to preserve the vertical and horizontal shear capacity as well as to keep the slab reinforcement means well protected with proper concrete coverage. There is a pair of outstanding arms extending out from each of the ends of the shear reinforcing members. Each of the outstanding arms has a 90 degree bend at the ends of the arms which provide for increased pull out tensile capacity of the weldment.

DESCRIPTION OF THE PREFERRED EMBODIMENT

Figure 1:
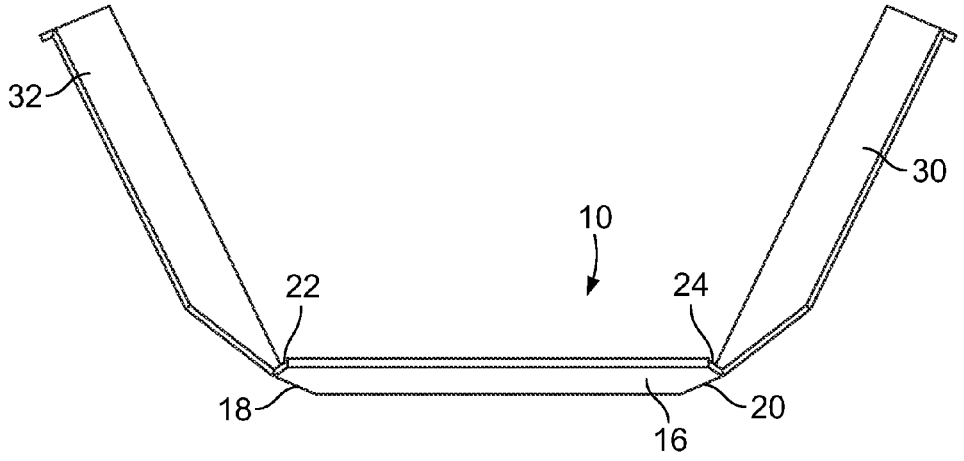
FIG. 1 is top plan view of the inventive weldment.
Figure 2:
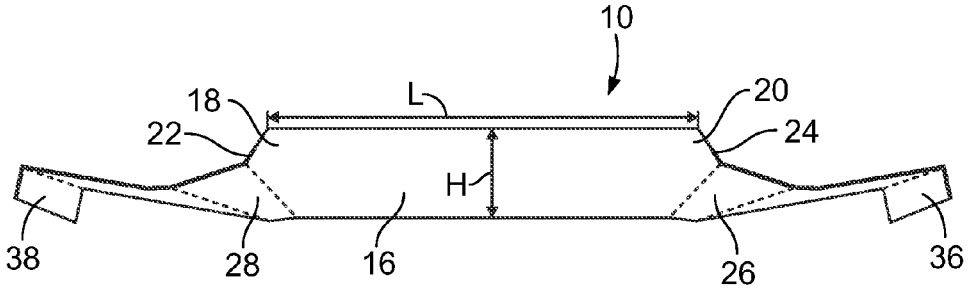
FIG. 2 is a front elevation view of the weldment shown in FIG. 1.
Figure 7:
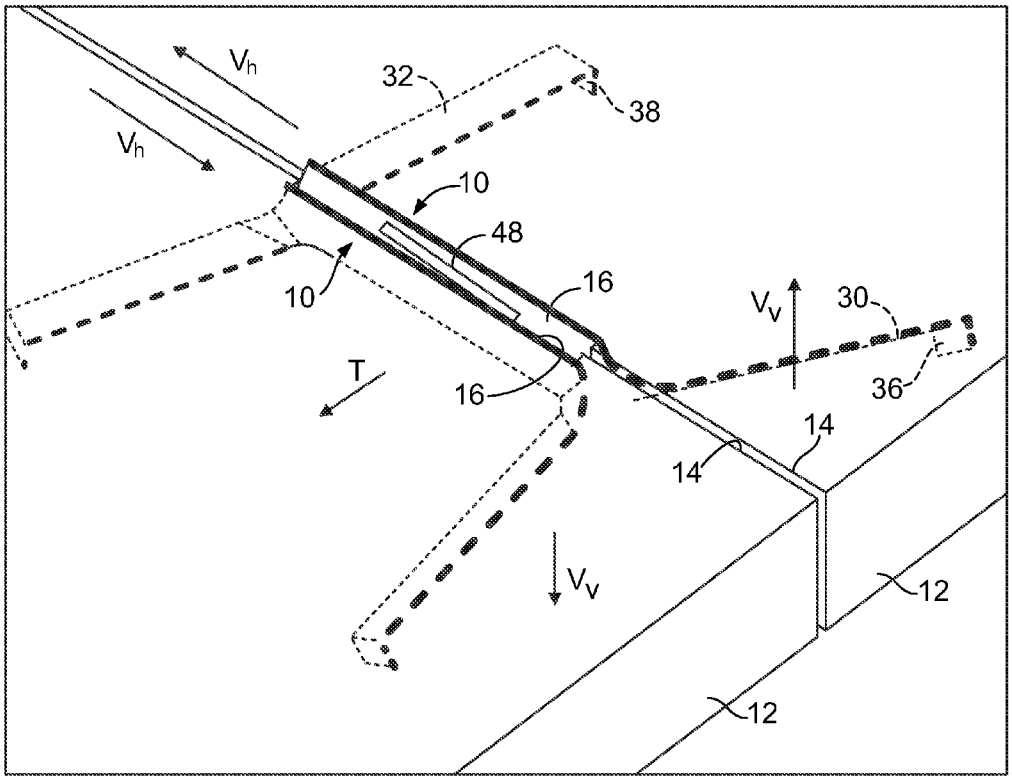
FIG. 7 is a perspective view of two concrete slabs each having a weldment embedded within, with the exterior face of the central plates facing each other.
Figure 8:
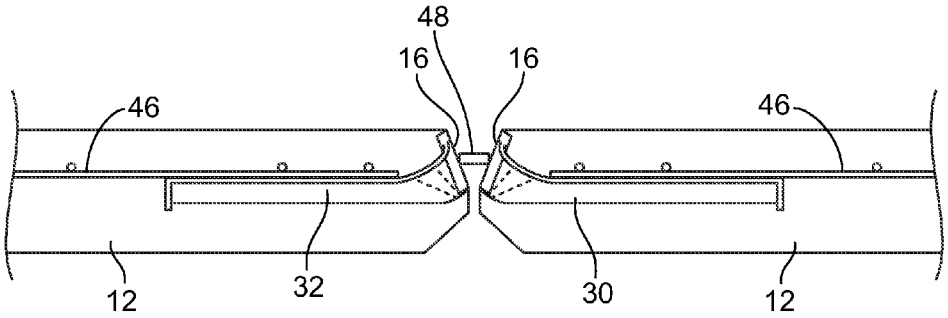
FIG. 8 is a section view with portions removed of two adjacent concrete slabs illustrating the position of the weldments in each slab with respect to each other.
Figure 9:
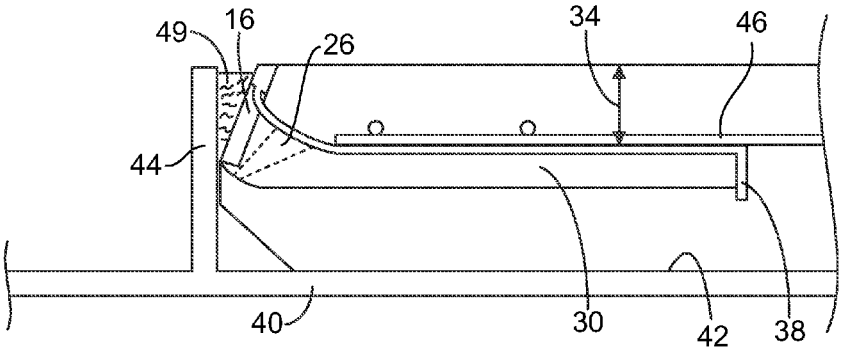
FIG. 9 is section view of the mold used for forming the concrete slab with the weldment and slab reinforcement placed in the mold.

Turning first to FIG. 1, there is illustrated a weldment 10 of the present invention. The weldment 10 is designed to be embedded in a thin concrete slab-type structural member 12 (hereinafter referred to as "concrete slabs"), generally having a thickness of no more than three inches. The concrete slabs are designed to have an extended length as compared to its width. The concrete slabs 12 are positioned so that edges 14 of adjacent concrete slabs 12 abut each other as seen in FIGS. 7-9 to form a building element such as a deck surface. Several weldments 10 are placed at predetermined distances along the edge 14 of the concrete slabs 12. Thus when the concrete slabs 12 are placed confronting each other, the weldments 10 are in alignment with weldments in the confronting concrete slab 12 and are in close proximity to each other so that the weldments 10 can be welded together thereby increasing the overall strength of the deck surface. The horizontal shear capacity of the weldment 10 will provide the shear requirement to make the concrete slabs 12 act as one diaphragm after welded together. After the concrete slabs 12 are welded together to form the precast deck, a pour in place composite concrete topping is cast on top of the thin concrete slabs to support the final dead and live loads. During construction, the vertical shear capacity due to uneven loading of casting concrete is also carefully considered.

The design of the weldment 10 is most clearly illustrated in FIGS. 1-6. There is a central plate 16 having first and second ends 18 and 20 respectively. The weldment also has a height "H" and a length "L" that is greater than the height H. The height H is selected so that it is less than the thickness of the concrete slab 12. The central plate 16 has a ⅜ inch chamfer 22, 24 at both ends 18, 20. Beyond the first and second ends 18, 20 are shear force reinforcing members 26, 28 that provide a transition piece to attach the central plate 16 to right and left outstanding divergent arms 30 and 32 respectively. From the front view of FIG. 2, the right arm 30 is twisted clockwise and the left arm 32 is twisted counter clockwise 45° from a vertical or horizontal plane. The entire twisting is accomplished across the shear reinforcing members 26 and 28. The purpose of the twisting of the arms 30 and 32 is to provide the proper amount of concrete coverage 34 above the arms 30 and 32 within the concrete slab 12 as seen in FIG. 9.

Figure 3:
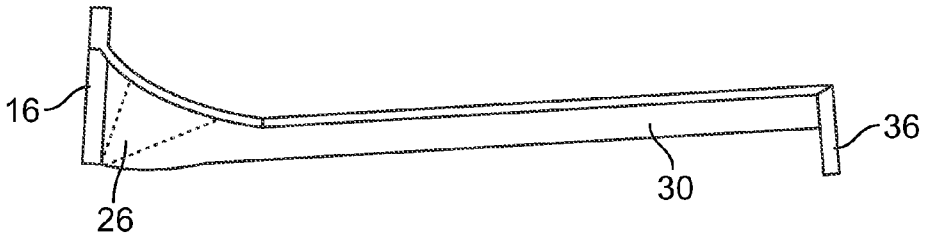
FIG. 3 is a right side elevation view of the weldment.
Figure 4:
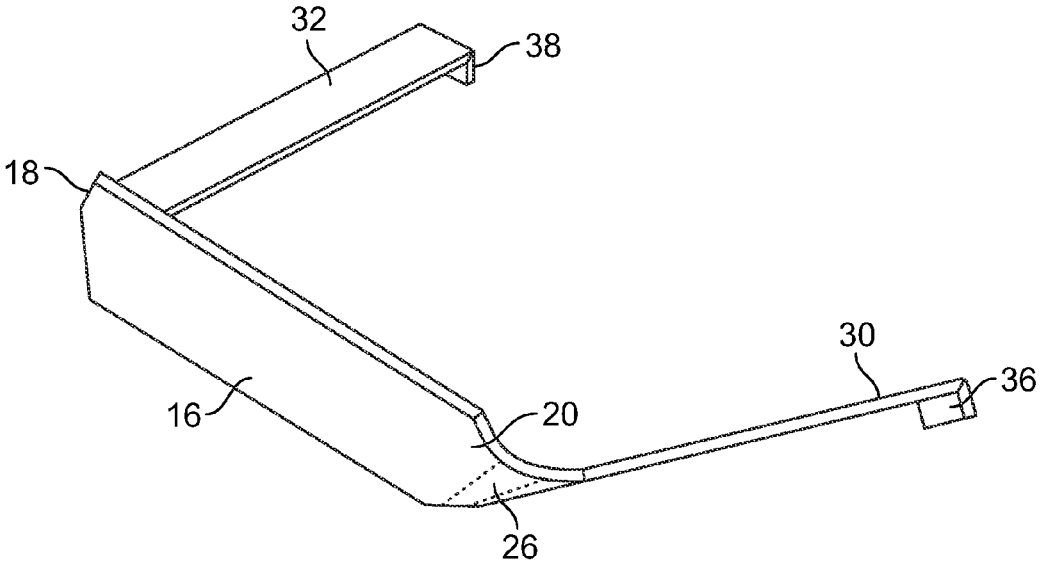
FIG. 4 is a front perspective view of the weldment.
Figure 5:
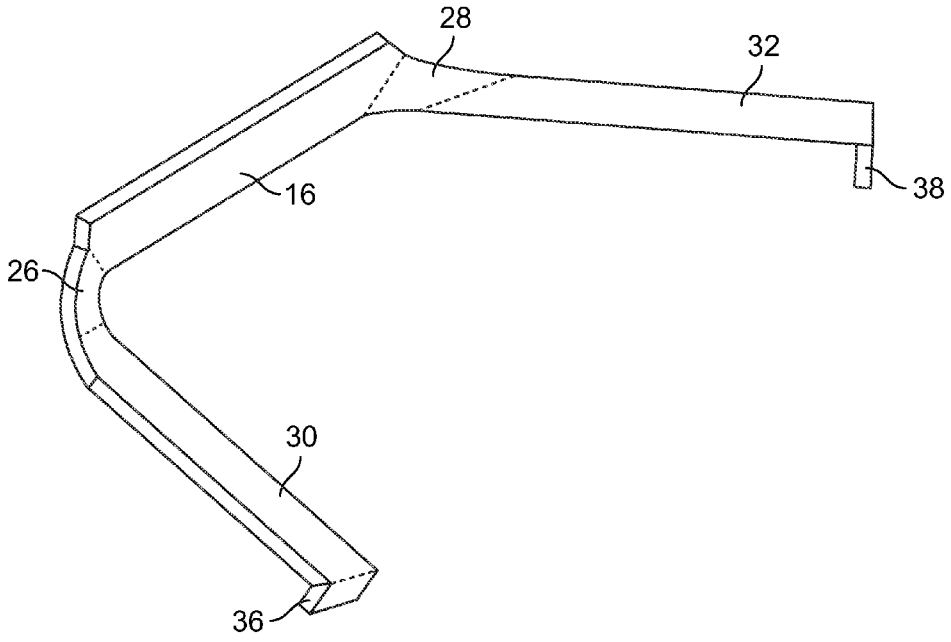
FIG. 5 is a rear perspective view of the weldment.
Figure 6:
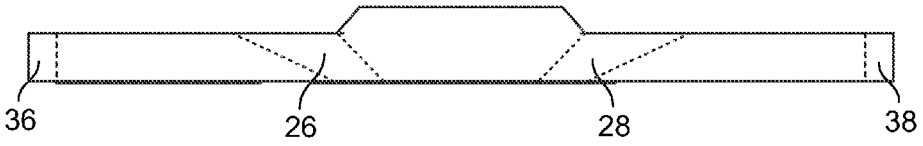
FIG. 6 illustrates the blank weldment after it is stamped and before it is bent and twisted into the final form.

The twisting should not be so great that it results in a hinge effect which minimizes the strength of the weldment 10 at the point of twisting. This hinge effect is seen in U.S. Pat. No. 6,854,232 wherein the arms are rotated 90° (as seen in FIG. 3 of U.S. Pat. No. 6,854,232) which results in the hinge effect when the concrete slabs are subjected to vertical shear. The design of the weldment in the '232 patent greatly reduces the vertical shear capacity of the weldment 10 and causes concrete spall in the slab when the loading of two adjacent slabs are not even.

At the ends of the arms 30 and 32 are downwardly extending fingers 36, 38 that extend at substantially 90° from the divergent arms 30 and 32 respectively. The fingers 36, 38 assist in anchoring the weldment 10 in the concrete slab 12 and provides additional tensile strength capacity.

The central plate 16, shear force reinforcing member 26, 28, right and left divergent arms 30, 32 and fingers 36,38 are all manufactured from one piece of metal, preferable a high strength steel. Thus the central plate, reinforcing members, divergent arms and fingers are all integral with each other giving substantial strength to the weldment 10. The 45° twist of the divergent arms being spread across the shear force reinforcing member 26, 28 provides increased vertical and horizontal shear capacity over the weldments of the prior art.

The method of manufacturing the concrete slab 12 is best illustrated in FIG. 9. A mold or steel form 40 is used to form the slab 12. The mold 40 has a bottom 42 and side walls 44 which define the bottom and edges of the length and width of the thin concrete slab 12. Mesh 46 is placed in the form 40 and is mounted at the correct height to provide proper coverage of the mesh 46 and weldment 10. The weldment 10 is attached to the bottom of the mesh 46. This secures the arms 30, 32 to the mesh 44 such that the arms 30, 32 are horizontally parallel to the bottom 42 of the mold 40 and therefore horizontally parallel to the finished slab 12. This results in the surface of the central plate 16 being at approximately a 30° angle from the vertical plane of the vertical side wall 44. This design facilitates field welding of a weld plate 48 (FIG. 7) between adjacent confronting weldments 10.

Once the weldment 10 is properly positioned within the mold 40 as described above, concrete is poured into the mold 40 to the proper depth of the concrete slab. It is preferable for the top edge of central plate 16 to be flush with or slightly below the top of the concrete slab 12. To keep the exterior surface of the central plate 16 clean and suitable for welding, a temporary wedge type plastic or wood mold 49 can be inserted in the mold 40 and used to keep wet concrete off the central plate surface.

Turning to FIG. 8, there are illustrated two concrete slabs 12 in face to face orientation. Each slab 12 has at least one weldment 10 embedded within the slab 12. The central plate 16 of each weldment 10 faces the other. With the two slabs 12 slightly separated by approximately ¼ inches, the welding plate 48 is placed between the two central plates 16. With the 30° tilt of the central plates 16, it is convenient to place the welding plate 48 into the V shaped notch formed by the two tilted central plates 16 and do the welding so that a unitary structure is created by the two central plates 16, the welding plate 48 and the field weld. This V shaped notch will be filled with concrete during the topping pouring operation.

FIG. 7 is similar to FIG. 8 except it is a perspective view with portions removed illustrating the position of the weldments 10 when the two concrete slabs 12 are facing each other. The welding plate 48 is positioned between the two slabs 12 and supported by the central plate 16. Once the field weld is made, the two concrete slabs 12 act as one unitary structure. It resists horizontal shear, vertical shear and tensile forces in both directions as illustrated by arrows Vh, Vv and T.

The weldments 10 can be manufactured from steel blanks stamped from sheets. By properly laying out the stamping of the blank weldments as shown on FIG. 6, the use of the steel material can be maximized and the waste material minimized. Once the blank weldments have been punched, they can be formed by standard metal bending operations and no additional parts must be added to the weldment to complete the finished piece.

Thus there has been provided a concrete weldment that fully satisfies the objects and advantages set forth above. While the invention has been described in conjunction with a specific embodiment, it is evident that many alternatives, modifications and variations will be apparent to those skilled in the art in light of the foregoing description. Accordingly, it is intended to embrace all such alternatives, modifications and variations as fall within the spirit and scope of the appended claims.

What is claimed is:

1. A concrete weldment for embedding into a thin slab precast concrete structural member that has a length, a width, horizontal top and bottom surfaces that define a thickness of no greater than three inches, and further has an exposed edge, the weldment comprising:

a single integral steel bar having a central weldable plate having a length and a height and opposed first and second ends, a left outstanding arm having one end terminating in an end flange that extends from the one end at substantially 90°, and an opposite end twisted at substantially 45° from the central plate and 45° from the horizontal surface and integral with the first end of the central plate, a right outstanding arm having one end terminating in an end flange that extends from the one end of the right outstanding arm at substantially 90°, and an opposite end of the right outstanding arm twisted at substantially 45° from the central plate and 45° from the horizontal surface and integral with the second end of the central plate, the central plate having a front surface disposed at an angle between 50° and 75° from the outstanding arms when the arms are embedded into the concrete structural member, the front surface further disposed along the exposed edge of the concrete structural member and presenting a weldable surface from the concrete structural member.

2. The concrete weldment of claim 1 wherein the outstanding arms have a constant height, the height being less than the height of the central weldable plate, the outstanding arms supporting reinforcement members within the concrete structural member when the outstanding arms are embedded in the concrete structural member.

3. The concrete weldment of claim 1 wherein the outstanding arms have a substantially flat planar surface that is disposed at an angle of substantially 45° from the horizontal top and bottom surfaces of the concrete structural member when the weldment is embedded in the concrete structural member.

4. The concrete weldment wherein the arms extend out from the central plate at an angle of between 25° and 40° as measured from a line parallel to the length of the weldable plate.

5. A concrete weldment for embedding into a thin slab precast concrete structural member, the weldment and concrete structural member comprising:

a concrete structural member having a length, a width, horizontal top and bottom surfaces that define a thickness of no more than three inches, and an exposed edge, a central weldable plate having a length and a height and opposed first and second ends, the central weldable plate having a front surface to present a weldable surface from the concrete structural member, a shear force reinforcing member integrally formed with each of the before opposed first and second ends, the shear force reinforcing member having opposed proximal and distal ends, the proximal ends integrally formed with the ends of the central weldable plate and the distal ends integrally formed with an outstanding arm that extends divergently out from the shear force reinforcing member, the shear force reinforcing member rotated substantially 45° from the central plate, the rotation of the shear force reinforcing member causing the outstanding arms to be oriented at substantially 45° with respect to the horizontal plane top and bottom surfaces of the concrete structural member, the front surface disposed at an angle between 50° and 75° from the horizontal top and bottom surfaces of the concrete structural member when the arms are embedded in the concrete structural member, the front surface further disposed along the exposed edge, and end flanges extending out from the outstanding arms at substantially 90° for further securing the weldment inside of the concrete structural member.

6. The concrete weldment of claim 5 wherein the outstanding arms have a constant height, the height being less than the height of the central weldable plate, the outstanding arms supporting reinforcement members within the concrete structural member when the outstanding arms are embedded in the concrete structural member.

7. The concrete weldment of claim 5 wherein the outstanding arms have a substantially flat planar surface that is disposed at an angle of substantially 45° from the horizontal top and bottom surfaces of the concrete structural member when the weldment is embedded in the concrete structural member.

8. The concrete weldment of claim 5 wherein the arms extend out from the central portion at an angle of between 25° and 40° as measured from a line parallel to the length of the weldable plate.

* * * * *